US006056459A

United States Patent [19]

Tsai

[11] Patent Number: 6,056,459

[45] Date of Patent: May 2, 2000

[54] BALANCE DEVICE FOR KEY

[75] Inventor: Ching Cheng Tsai, Keelung, Taiwan

[73] Assignee: Chicony Electronics Co., Ltd., Taipei Hsien, Taiwan

[21] Appl. No.: 09/225,331

[22] Filed: Jan. 5, 1999

[51] Int. Cl.[7] ..... B41J 5/08

[52] U.S. Cl. ..... 400/496; 200/344

[58] Field of Search ..... 400/472, 490, 400/495, 495.1, 496, 491.2, 473, 479, 480, 481, 488, 491, 491.1, 491.3, 492, 682, 691, 692, 693; 248/584, 585; 345/167, 168, 169; 235/1 D, 145 R, 146; 361/680, 683; 341/21, 23; 200/341, 344, 345, 339, 520, 342, 329

[56] References Cited

U.S. PATENT DOCUMENTS 4,433,225 2/1984 Cowles ..... 200/340

4,580,022 4/1986 Oelsch et al. ..... 400/496

5,819,914 10/1998 Yoneyama ..... 200/344

5,823,325 10/1998 Lin ..... 300/344

5,941,373 8/1999 Cheng ..... 200/344

*Primary Examiner*—John S. Hilten

*Assistant Examiner*—Amanda B. Sandusky

*Attorney, Agent, or Firm*—Rosenberg, Klein & Lee

[57] ABSTRACT

A balance device for key comprises two balance rods each arranged on the front side and rear side of the cap of the key. The two balance rods are arranged in a forficiform arrangement. The base plate of the key and the cap being provided with pivoting parts such that the balance rods being pivotably engaged within the pivoting part. Therefore, the key can be uniformly pressed, no matter where the pressing force for key is applied.

8 Claims, 3 Drawing Sheets

BALANCE DEVICE FOR KEY

FIELD OF THE INVENTION

The present invention relates to a balance device which comprises two balance rods arranged adjacent a front edge and a rear edge of a key cap in crossed orientation, whereby a depression force applied to the key cap is balanced to produce the key cap's stable displacement.

BACKGROUND OF THE INVENTION

Some keys of a conventional keyboard, such as a space key, are generally of an extended, long strip configuration. Therefore, a balance device is necessary for such keys. As shown in FIG. 3, a prior art balance rod 71 is pivotally arranged within a support assembly for a space key 7. One end of the balance rod 71 is pivotally connected at a front side of the space key 7. The balance rod 71 extends in angled orientation, with its other end pivotally connected to the base plate 72 of the keyboard. When the finger of a user presses at the side of the space key 7 which is pivotally connected to the balance rod 71, the pressing force is uniformly applied over the key. However, when the user's finger presses at the side of the space key 7 not connected to the balance rod 71, the pressing force is not uniformly applied over the key. Consequently, the key stroke operation may not be performed effectively. This problem is heightened in notebook type computers, the keys of which are arranged in more compact manner.

It is the object of the present invention to provide a balance device for a key, which has two balance rods having pivoting pole portions arranged, respectively, to extend adjacent the front and back edges of a key cap and supporting pole portions arranged in crossed manner. By use of the balance device, the key cap may be uniformly depressed, no matter where on the key cap the pressing force is applied.

BRIEF DESCRIPTION OF THE DRAWINGS

The various objects and advantages of the present invention will be more readily understood from the following detailed description when read in conjunction with the appended Drawings, in which.

DETAILED DESCRIPTION OF THE PREFERRED EMBODIMENTS

Figure 1:
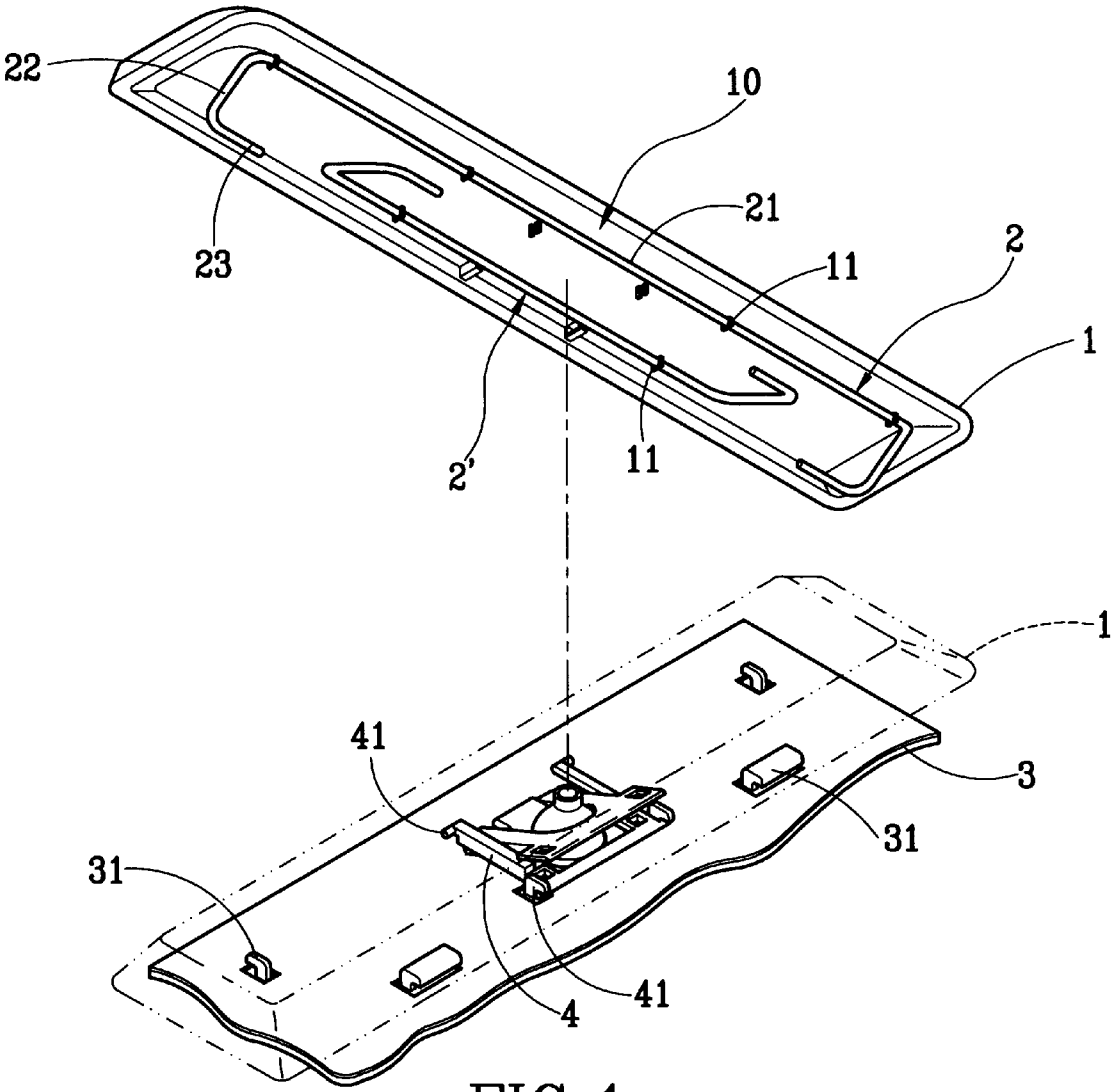
FIG. 1 is an exploded view of one embodiment of the present invention.

As shown in FIG. 1, the inventive balance device 10 is shown used in a space key having an extended, long strip configuration. However, the inventive device 10 is also applicable to other keys on a keyboard. The balance device, or assembly, 10 comprises two balance rods 2 and 2' respectively coupled to the space key along front and back edges, and arranged to cross one another. In this embodiment, the first balance rod 2 has a first pivoting pole portion 21, two supporting pole portions 22 extending transversely from opposing ends of the first pivoting pole portion 21, and second pivoting pole portions 23 bent from the supporting pole portions 22 to extend in parallel relation to the first pivoting pole portion 21. A base plate 3 of the keyboard is provided with pivoting parts 31 along front and rear sides thereof. Each pivoting part 31 is configured as an open, slide-accessible groove. Formed on cap 1 of the space key are pivoting parts 11 configured as fixed grooves, adapted for captively receiving a pole portion.

Figure 2:
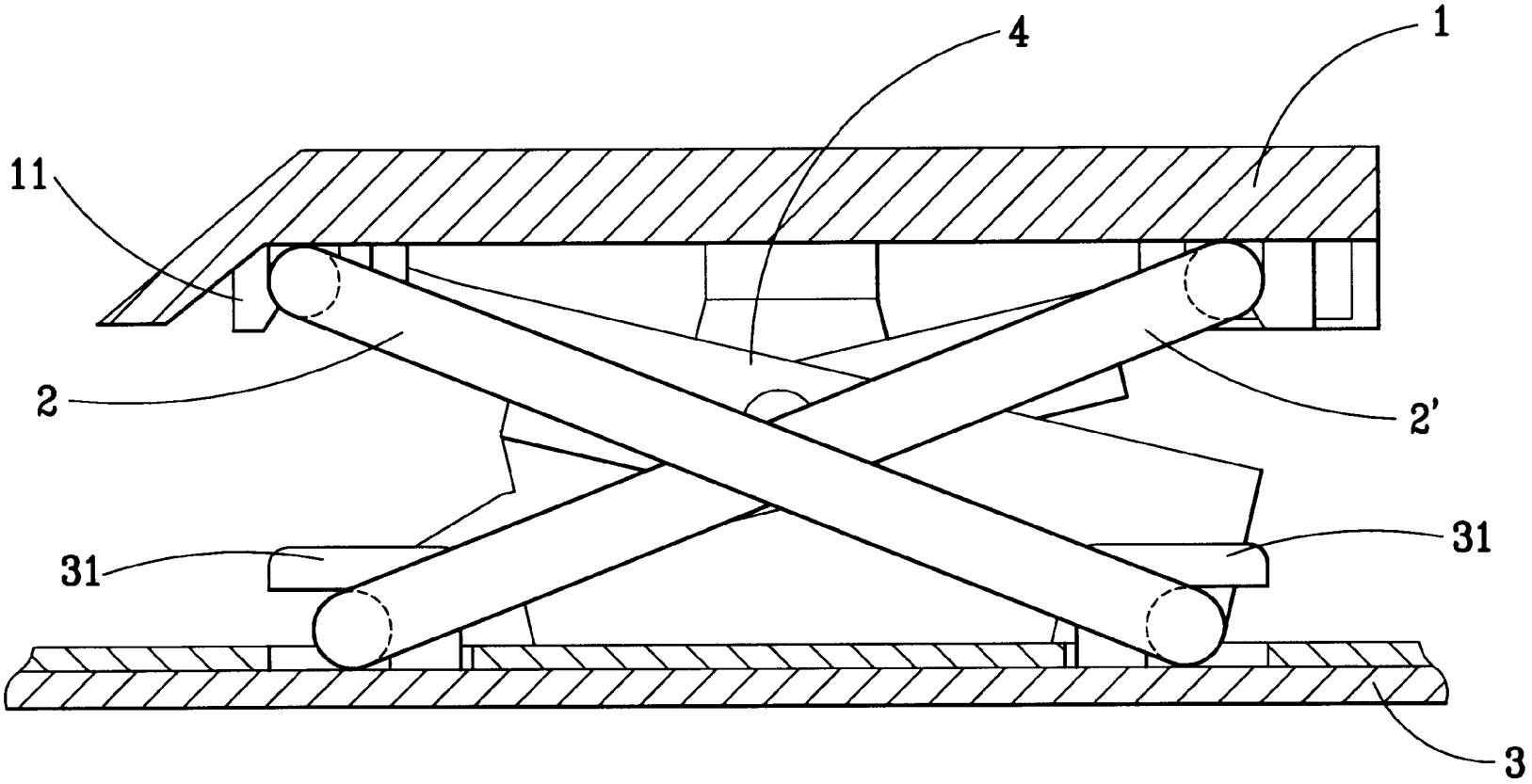
FIG. 2 is a cross-section view of one embodiment of the present invention; and, FIG. 3 is a cross-section view of a prior art support assembly balance device.
Figure 3:
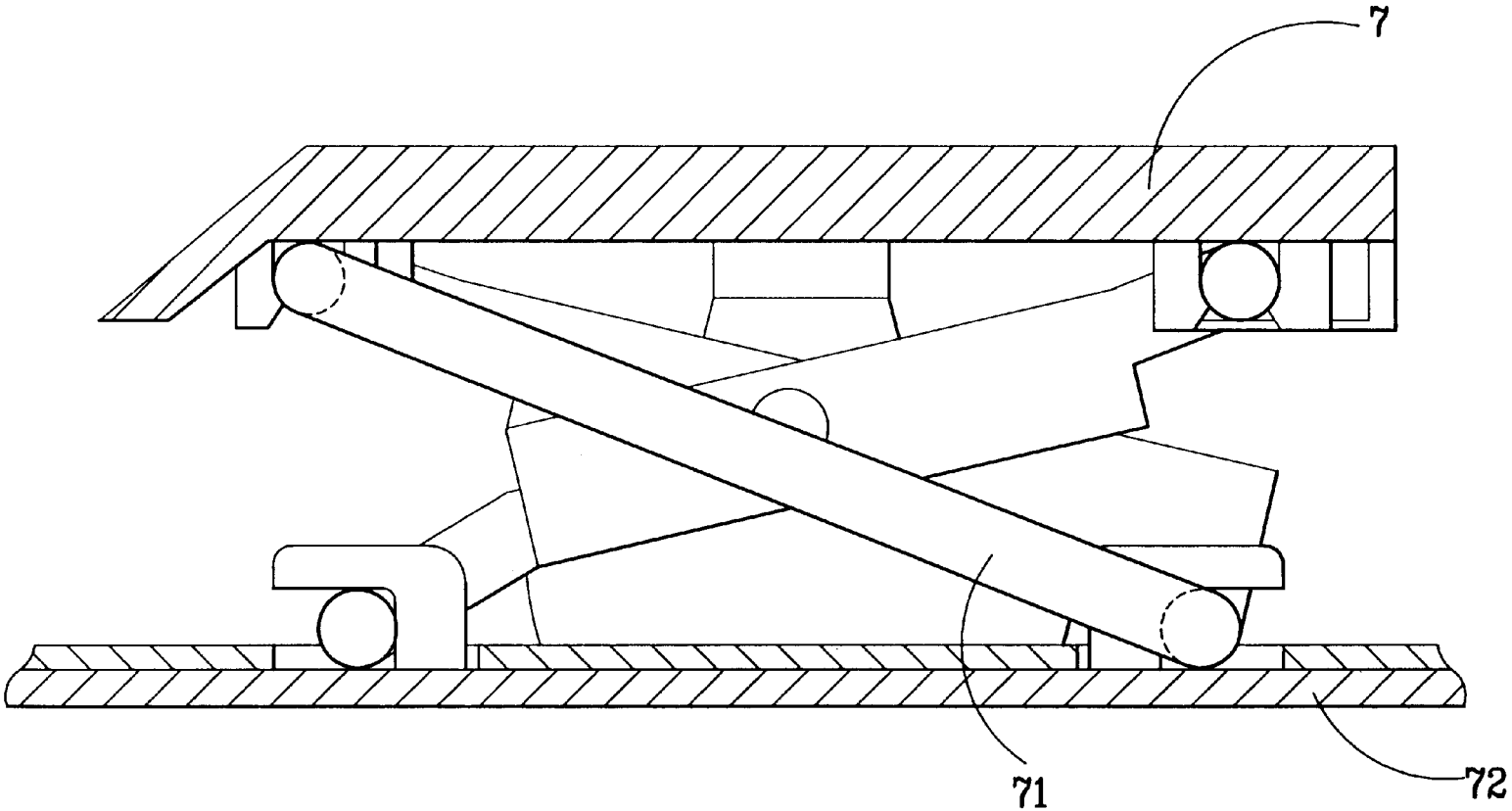
FIG.3 PRIOR ART

As shown in FIG. 2, when assembling the balance structure, the first pivoting pole portions 21 of the balance rods 2, 2' pivotally engage the pivoting parts 31 of the base plate 3, respectively. The second pivoting pole portions 23 of the balance rods 2, 2' are pivotally arranged within the pivoting parts 11. When the finger of a user presses the space key, the pivoting shaft 41 of a bridge assembly frame 4 is displaced accordingly. The second pivoting pole portions 23 of the balance rods 2, 2' are correspondingly displaced such that the space key is uniformly depressed. An elastic member within the bridge assembly is also uniformly depressed to contact the circuit on the circuit board beneath it, thus forming a closed circuit.

In the present invention, the balance rods 2, 2' are provided to extend respectively adjacent the front and back edges of the space key. This enables the space key to be uniformly depressed, no matter where along its length the depressing force is applied.

In summary, the inventive balance device can substantially improve the problem of non-uniform depression of a key, especially for such keys as those of a compact notebook computer. The provisions of the invention are industrially advantageous.

Although the present invention has been described with reference to the preferred embodiments thereof, it will be understood that the invention is not limited to the details thereof. Various substitutions and modifications have been suggested in the foregoing description. Other substitutions and modifications will occur to those of ordinary skill in the art. Therefore, all such substitutions and modifications are intended to be embraced within the scope of the invention as defined in the appended Claims.

I claim:

1. A key switch device comprising:

(a) a key cap having longitudinally extending first and second edges;

(b) a base plate;

(c) a collapsible bridge assembly coupled to said key cap and said base plate, said collapsible bridge assembly resiliently supporting said key cap on said base plate to be displaceable between actuating and non-actuating positions; and, (d) a balance assembly coupled to said key cap and said base plate for distributing a depression force applied to said key cap; said balance assembly including first and second balance rods, each said first and second balance rod having at least a pair of longitudinally extended balance pole portions spaced one from the other by a supporting pole portion extending transversely therebetween, at least one said balance pole portion of each said first and second balance rod being pivotally coupled to said base plate, said first balance rod having at least one said balance pole portion pivotally coupled to said key cap adjacent said first edge thereof, said second balance rod having at least one said balance pole portion pivotally coupled to said key cap adjacent said second edge thereof.

2. The key switch device as recited in claim 1 wherein at least one said supporting pole portion of said first balance rod being oriented in crossed relation to at least one said supporting pole of said second balance rod when said key cap is in said non-actuating position.

3. The key switch device as recited in claim 1 wherein said key cap is elongated longitudinally in contour.

4. The key switch device as recited in claim 1 wherein each said first and second balance rod includes a pair of said supporting pole portions extending transversely from distal ends of a primary one of said balance pole portions, and a secondary one of said balance pole portions extending from a terminal end of each said supporting pole portion.

5. The key switch device as recited in claim 4 wherein each said first and second balance rod is integrally formed.

6. The key switch device as recited in claim 5 wherein said primary balance pole portion of each said first and second balance rods is pivotally coupled to said key cap.

7. The key switch device as recited in claim 1 wherein said base plate includes a plurality of pivoting parts each defining an open groove pivotally receiving one said balance pole portion of said balance rods.

8. The key switch device as recited in claim 1 wherein said key cap includes a plurality of pivoting parts each pivotally receiving in captive manner one said balance pole portion of said balance rods.

* * * * *